United States Patent [19]

Young

[11] Patent Number: 4,730,425

[45] Date of Patent: Mar. 15, 1988

[54] RETURNED STAIR TREAD HAVING MOISTURE COMPENSATED JOINT AND METHOD FOR MAKING SAME

[76] Inventor: Robert H. Young, P.O. Box 167, Beaver Dam, Ky. 42320

[21] Appl. No.: 17,863

[22] Filed: Feb. 24, 1987

[51] Int. Cl.[4] ..... E04F 11/00

[52] U.S. Cl. ..... 52/182; 52/179; 52/716; 52/829

[58] Field of Search ..... 52/179, 182, 183, 184, 52/188, 191, 716–718, 829

[56] References Cited

U.S. PATENT DOCUMENTS

| | | | |
|---|---|---|---|
| 381,407 | 4/1888 | Momberg . | |
| 2,024,032 | 12/1935 | Elgood | 52/182 X |
| 3,393,481 | 7/1968 | Meuret . | |

FOREIGN PATENT DOCUMENTS

| | | | |
|---|---|---|---|
| 951765 | 10/1956 | Fed. Rep. of Germany | 52/182 |
| 99667 | 6/1873 | France | 52/182 |
| 795301 | 3/1936 | France | 52/188 |

OTHER PUBLICATIONS

Suckno Brothers Leaflets on Staircase Construction.

*Primary Examiner*—Alfred C. Perham
*Assistant Examiner*—Richard E. Chilcot, Jr.
*Attorney, Agent, or Firm*—Maurice L. Miller, Jr.

[57] ABSTRACT

A returned tread for use on an open portion of a stairway having a stair tread constructed of wood and a return nosing joined on at least one side edge of the stair tread so as to form an exposed shaped or mitered joint on a forward side edge portion of the assembly. The surface of the nosing which opposes the stair tread and the side edge of the stair tread are joined along at least a part of their adjoining surfaces by tongue and groove construction. A single finishing nail, wood screw or other suitable fastener secures the nosing to the stair tread at a position just rearward of the exposed joint. As a result, the stair tread and nosing will not slide relative to one another at the position of the fastener or in a region next to the fastener that includes the exposed joint as the rest of the stair tread expands and contracts in width over a range due to ambient temperature and humidity changes. In the alternative, a suitable wood adhesive may be applied to the opposing surfaces of the nosing and stair tread in and along the exposed joint without using the fastener. Preferably, the nosing and stair tread are secured to one another by both gluing the opposing surfaces of the nosing and tread together along the exposed joint and by fastening the nosing and tread together with a suitable fastener as previously explained.

18 Claims, 8 Drawing Figures

RETURNED STAIR TREAD HAVING MOISTURE COMPENSATED JOINT AND METHOD FOR MAKING SAME

BACKGROUND OF THE INVENTION

This invention relates generally to returned stair treads and more specifically to returned stair treads containing exposed joints on forward side edge portions thereof that will not pull apart, gap or otherwise become deformed due to changes in ambient temperature and humidity.

Returned stair treads, generally speaking, have long been known and used in the prior art. Typically such prior art stair treads include a tread constructed of wood with a return nosing affixed to a side edge of the former so as to form an exposed joint along a forward side edge portion of the assembly. The nosing is usally glued to the side edge of the tread along the entire width of the latter and, in addition, is nailed thereto at several different positions.

A major problem that has been encountered with such construction is that the exposed joint will tend to gap open or otherwise become deformed when the returned stair tread is exposed to ambient temperature and humidity conditions beyond those encountered when the nosing was originally affixed to the stair tread. Such conditions are usually at their worst during late Summer when returned treads are stored or otherwise disposed in non-airconditioned circumstances such as in a warehouse or building under construction.

By means of my invention, this difficulty encountered with prior art returned stair treads is substantially overcome.

SUMMARY OF THE INVENTION

It is an object of the present invention to provide a returned tread for use on an open stairway or an open portion of a stairway which contains an exposed joint on a forward side edge portion that will not pull apart or otherwise become deformed as a result of changes in width of the tread over a range such as can be caused by changes in ambient temperature and humidity.

It is a further object of my invention to provide a method for making a returned tread for stairways which has an exposed joint on a forward edge thereof which will not become gapped or deformed as a result of expansion or contraction of the width of the stair tread over a range due to changes in ambient temperature and humidity.

Briefly, in accordance with my invention, there is provided a returned tread for use on an open stairway or open portion of a stairway which includes a stair tread constructed of wood and having at least one side edge fashioned to fit flush against an opposing surface of a return nosing to form an exposed joint between the stair tread and nosing along a forward end of the latter. Also included is a return nosing fitting flush against the side edge of the stair tread, the stair tread and nosing being slidably connected to each other by tongue and groove construction extending along at least a rear portion of the side edge. Means for securing the nosing to the stair tread is also included to prevent gapping or other deformation of the exposed joint as the stair tread expands or contracts in width over a range due to changes in ambient temperature and humidity conditions.

These and other object, features and advantages of my invention will become apparent to those skilled in the art from the following detailed description and attached drawings upon which only the preferred embodiments of my invention are illustrated.

DESCRIPTION OF THE PREFERRED EMBODIMENTS

Figure 1:
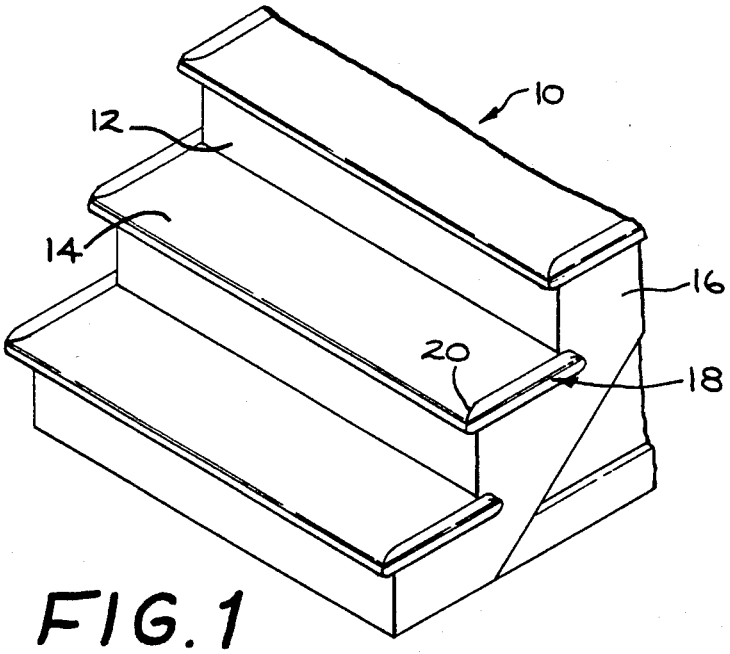
FIG. 1 shows a perspective view of a portion of an open stairway having return nosings connected to side edges of various stair treads, thus illustrating one preferred embodiment of my invention.

Referring now to FIGS. 1–4 of the drawings, there is shown, in one preferred embodiment of my invention, an open stairway 10 having risers 12, wooden treads 14 and a stringer 16 on the open side or sides thereof. The risers 12 and treads 14 will usually be of selected height and width, respectively, to meet building code requirements. A front edge portion of each tread 14 rests upon and extends forwardly beyond a different one of the risers 12 in overlapping relationship therewith while side edge portions of each tread 14 rest upon a different horizontally extending upper edge of the stringers 16, only one of which is shown. A return nosing 18 is connected to each side edge portion of each of the treads 14 which lie in an open portion of the stairway 10. In the example of FIG. 1, the return nosings 18 and the corresponding treads 14 to which they are connected form a rounded or shaped, exposed joint 20 on the forward ends of the side edge portions thereof as viewed in plan. The rearward end portions of the nosings 18 extend behind corresponding risers 12 along and flush with the stringer 16 for short distances. FIG. 1 shows only the conventional portions of the treads 14 and nosings 18 of my invention as they would appear on an open stairway in a fully assembled state.

Figure 2:
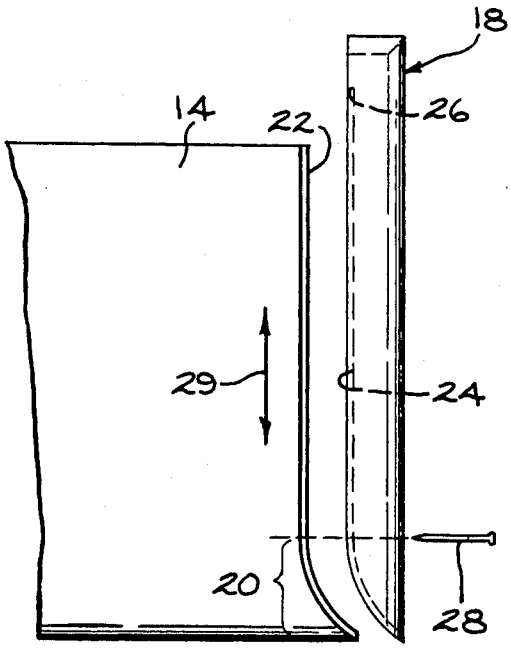
FIG. 2 shows a plan view of a side portion of one of the stair treads of FIG. 1 and its corresponding return nosing exploded therefrom.
Figure 3:
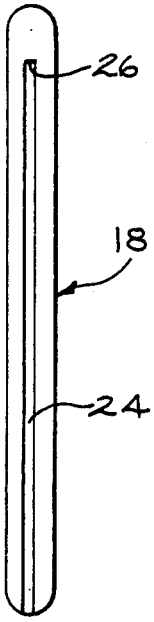
FIG. 3 shows an edge view of the return nosing of FIG. 2 rotated ninety degrees from its position as shown in the latter figure to illustrate a longitudinally extending groove therein.
Figure 4:
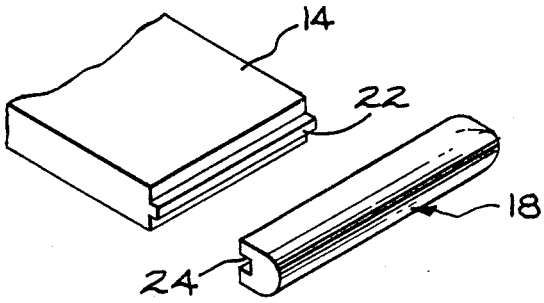
FIG. 4 shows a perspective view of a fragment of the stair tread and return nosing of FIG. 2 further illustrating tongue and groove construction of the two components.
Figure 5:
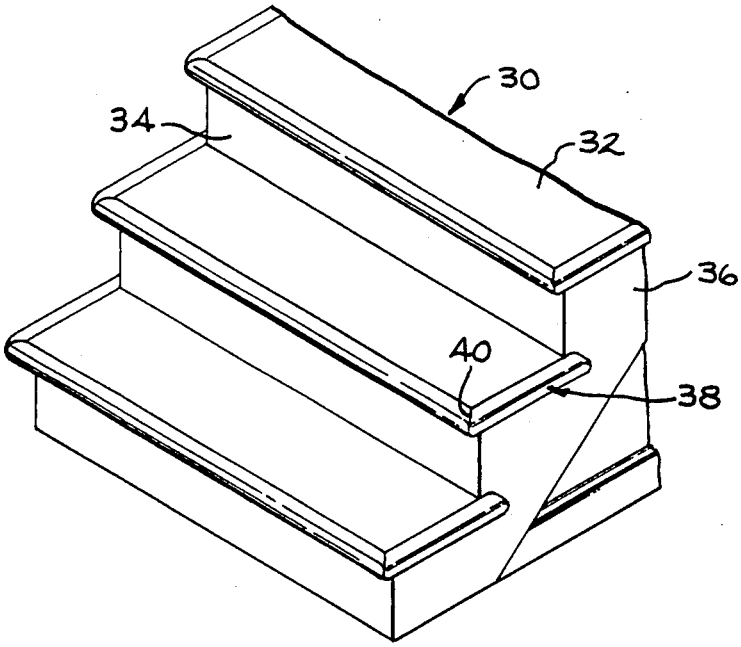
FIG. 5 shows a perspective view of a portion of an open stairway having return nosings connected to side edges of various stair treads, thus illustrating another preferred embodiment of my invention.
Figure 6:
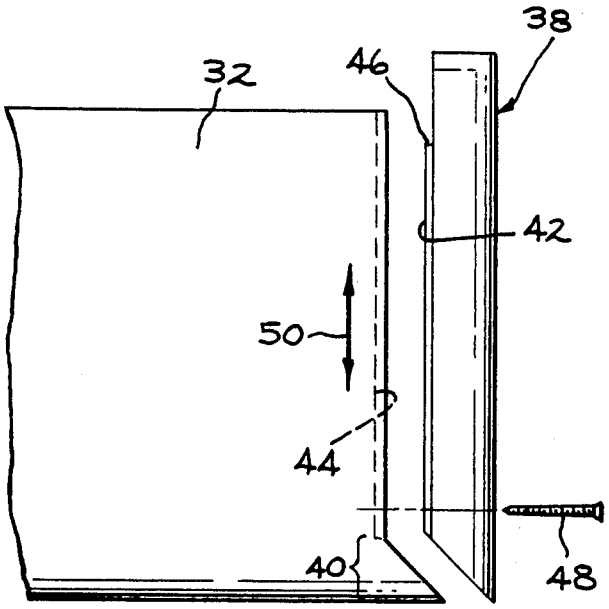
FIG. 6 shows a plan view of a side portion of one of the stair treads of FIG. 5 and its corresponding return nosing exploded therefrom.
Figure 7:
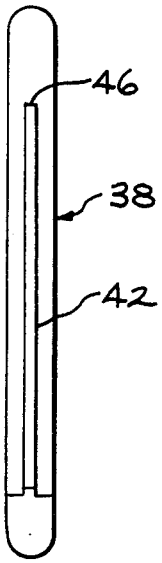
FIG. 7 shows an edge view of the return nosing of FIG. 6 rotated ninety degrees from its position as shown in the latter figure to illustrate a longitudinally extending groove therein.
Figure 8:
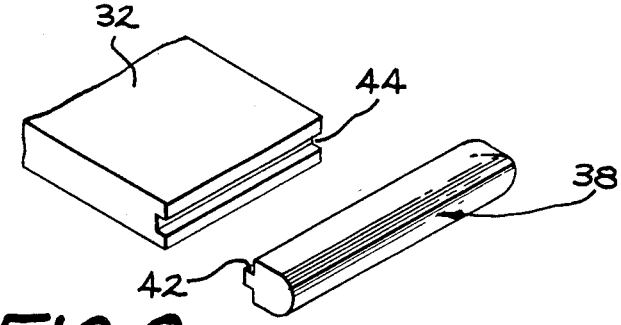
FIG. 8 shows a perspective view of a fragment of the stair tread and return nosing of FIG. 6 further illustrating tongue and groove construction of the two components.

Referring now particularly to FIGS. 2–4, the novel features of the tread 14 and return nosing 18 of my invention will be seen. Those two elements feature a tongue and groove type of construction. Specifically, a tongue 22 is formed along the entire side edge of the tread 14 including both the straight portion and the curved contour of the shaped portion where the shaped joint 20 occurs. An elongated groove 24, conforming in size and shape to the tongue 22 for close-fitting, longitudinally slidable relationship therebetween is formed in the edge of the nosing 18 which opposes the edge of the tread 14.

The groove 24 extends from the forward end of the nosing 18 to a position about an inch behind the rearward end of the tread 14 and tongue 22 as indicated at 26 short of the rearward end of the nosing 18. While the groove 24 could be formed all the way to the rearward end of the nosing 18 consistent with my invention, stopping the groove 24 short of the rearward end of the nosing 24 as shown insures that the rearward end of the groove 24 will not be visible from behind the nosing 18 so as to cause an unsightly appearance. A suitable wood glue or adhesive such as, for example, polyvinyl acetate is applied to the side edge of the tread 14 or the opposing surface of the nosing 18 along the shaped joint 20. A single finishing nail 28 (FIG. 2 only) or other suitable fastener is driven through the nosing 18 into a side edge portion of the tread 14 through a flat portion of the tongue and groove construction just rearward of the shaped joint 20. The nail 28 should be located in a region immediately rearward of and next to the rearward edge of the exposed joint 20 such that no significant gapping or deformation will occur in the exposed joint 20 even with substantial expansion and contraction of the width of the stair tread 14 over a range due to changes in ambient temperature and humidity. I have found that the nail 28 should not be positioned further than about 3 inches from the forward edge of tread 14 and the glue applied to the joint 20 should not extend rearward of the joint 20 beyond the position of the nail 28.

Now by reason of the fact that the wood grain of the tread 14 extends generally across its width from the front to the back thereof, expansion and contraction of the tread 14 will occur in the directions indicated by the double-headed arrow 29 (FIG. 2 only). As the tread 14 expands and contracts, the tongue 22 is free to slide along the groove 24 at every position along their adjoining surfaces except at the position of the nail 28 and along the glued joint 20. Since the nail 28 is located quite close to the joint 20, the latter lies within the region where little if any expansion or contraction will occur such that no unsightly gap or other deformation will occur in the joint 20 even where the tread 14 is exposed to relatively wide temperature and humidity variations and even where no glue or adhesive is used in the joint 20. Thus, while it is preferrable to use both glue in the joint 20 and a suitable mechanical fastener to fasten the nosing 18 to the tread 14, the latter two elements can be adequately secured together either by using glue in the joint 20, without using a mechanical fastener, or by using the fastener without gluing the joint 20.

Referring now to FIGS. 5–8, there is shown, in another preferred embodiment of my invention, an open stairway 30 having wooden treads 32, risers 34, a stringer 36 and nosings 38. In this example of the invention, the nosings 38 are joined to their corresponding treads 32 by means of a mitered joint 40 on a forward end portion thereof. As in the previous example, each nosing 38 is joined to a side edge of a tread 32 by means of tongue 42 and groove 44 construction. However, in the present example, the tongue 42 is formed on the nosing 38 while the conforming groove 44 is formed in the adjoining side edge of the tread 32. The groove 44 extends from the rearward end of the mitered joint 40 to the rearward end of the tread 32. The tongue 42 extends from the rearward end of the mitered joint 40 to a position 46 located at least an inch forward of the rearward end of the groove 44. A suitable wood adhesive may be applied to the opposing surfaces of the tread 32 and nosing 38 along the mitered joint 40. A single wood screw 48 (FIG. 6 only) or other suitable mechanical fastener extends through the nosing 38 and into an opposing side edge portion of the tread 32 at a position rearward of the mitered joint 40 which is no more than about three inches from the front edge of the tread 32 to insure that the entire nosing 38 will not slide along the side of the tread 32 in cases where the mitered joint 40 is not glued.

Here as in the previous example, the wooden tread 32 will expand and contract in the direction indicated by a double headed arrow 50 as the ambient temperature and humidity increases and decreases. Because of the tongue and groove construction, the tread 32 is free to slide relative to the nosing 38 in the directions shown by the arrow 50 at every point along its side edge except the position where the wood screw 48 is located. The wood screw 48 is located sufficiently close to the mitered joint 40 such that little if any difference in expansion and contraction will occur between the tread 32 and nosing 38 along the mitered joint 40 even with relatively large ambient temperature and humidity changes. In most cases, this means that the screw 48 should not be located more than about three inches rearward of the front edge of the tread 32 but that distance may vary somewhat due to the type of wood used in the tread 32 and the range of temperature and humidity over which the tread 32 is expected to be exposed. Accordingly, essentially no unsightly gapping or deformation of the mitered joint 40 will occur even over relatively wide ranges of temperature and humidity change. However, considerable sliding movement can occur between the tread 32 and nosing 38 as the distance from the wood screw 48 along the adjoining edges of the tread 32 and nosing 38 approaches the rearward end of the tread 32 as temperature and humidity changes occur.

In tests of treads and nosings of the type shown in FIGS. 1–4, I have taken treads and nosings which were joined immediately after having been kiln dried to seven percent moisture content and increased their moisture content to fifteen percent with no visible gap or deformation occurring in the shaped joint. Since most treads and nosings are joined after being kiln dried to about seven percent moisture content and since they will usually not absorb more than about 12–13 percent moisture while stored in a non-airconditioned warehouse in mid to late summer, my tests are believed to cover more than the full range of moisture conditions to which such materials will ordinarily be subjected. In either example of the invention as previously explained, while I prefer to secure the nosing to the stair tread by both gluing the opposing surfaces of the exposed joint together and by fastening the nosing to the stair tread with a suitable mechanical fastener such as a nail, screw, wooden dowel pin or the like, the exposed joint can be adequately secured by gluing the exposed joint without using a mechanical fastener or by using a mechanical fastener as shown in the examples without gluing the exposed joint.

Although the present invention has been described with respect to specific details of certain preferred embodiments thereof, it is not intended that such details limit the scope and coverage of this patent otherwise than as set forth in the following claims, such claims being intended to cover not only the invention as shown and described herein but also the reasonable equivalents thereof.

I claim:

1. A returned tread for use on an open portion of a stairway comprising a stair tread constructed of wood and having at least one side edge fashioned to fit flush against an opposing surface of a return nosing to form an exposed joint between said stair tread and nosing along a forward end portion of said thread and nosing, a return nosing fitting flush against said side edge, said stair tread and nosing being slidably connected to one another by tongue and groove construction extending along at least a rear portion of said side edge rearward of said exposed joint, and means for securing said nosing to said stair tread only in a region containing said exposed joint which is located on a forward end portion of said thread forward of said slidably connected construction to prevent gapping or other deformation of said exposed joint as said stair tread expands or contracts in width over a range due to changing ambient temperature and humidity conditions.

2. The returned tread of claim 1 wherein said securing means comprises a single mechanical fastener.

3. The returned tread of claim 2 wherein said exposed joint contains a suitable wood glue which does not extend rearwardly beyond said mechanical fastener.

4. The returned tread of claim 2 wherein said fastener is positioned rearwardly of said exposed joint but not more than about three inches from the front edge of said stair tread.

5. The returned tread of claim 2 wherein said single mechanical fastener comprises a nail.

6. The returned tread of claim 2 wherein said single mechanical fastener comprises a screw.

7. The returned tread of claim 2 wherein said single mechanical fastener is positioned in a region immediately rearward of and next to the rearward end of said exposed joint such that an insignificant amount of expansion and contraction occurs forward of said fastener such that no unsightly gapping or deformation of said exposed joint occurs over a range of changes in moisture content of said stair tread of between about 7 and 15 percent.

8. The returned tread of claim 2 wherein said securing means further comprises an adhesive or glue applied between the adjoining surfaces of said exposed joint.

9. The returned tread of claim 1 wherein said securing means comprises an adhesive or glue applied between the adjoining surfaces of said exposed joint.

10. The returned tread of claim 1 wherein said exposed joint comprises a shaped joint.

11. The returned tread of claim 1 wherein said exposed joint comprises a mitered joint.

12. The returned tread of claim 1 wherein said exposed joint comprises a shaped joint, and wherein said tongue and groove construction includes a tongue extending along the entire side edge of said stair tread, and a groove opposing said tongue and extending from the forward end of said nosing along said opposing surface to a position spaced beyond the rearward end of said stair tread for permitting said tongue to slide along said groove on a rear end portion of the tread rearward of said securing means.

13. The returned tread of claim 12 wherein said spaced position is also spaced from the rear end of said nosing.

14. The returned tread of claim 1 wherein said exposed joint comprises a mitered joint and wherein said tongue and groove construction includes a tongue extending from the rearward edge of said mitered joint rearwardly along said opposing surface of said nosing to a position spaced forward of the rear end of said stair tread, and a groove opposing said tongue and extending from a rearward end of said mitered joint along said side edge of said stair tread to the the rearward end thereof for permitting said tongue to slide along said groove on a rear end portion of the tread rearward of said securing means.

15. A method of for making a returned tread for use on an open stairway or an open portion of a stairway, the steps of which comprise providing a stair tread constructed of wood, fashioning at least one side edge of said stair tread to fit flush against an opposing surface of a return nosing to form an exposed joint between said stair tread and nosing along a forward end portion of said tread and nosing, providing a return nosing for fitting flush against said side edge, said stair tread and nosing being slidably connectable to each other by tongue and groove construction along a rear portion of said side edge, and securing said nosing to said tread only along a region containing said exposed joint which is located on a forward end portion of said tread forward of said slidably connected construction such that no significant gap or deformation will occur in said exposed joint as the result of expansion or contraction of said stair tread over a range of ambient temperature and humidity.

16. The method of claim 15 wherein said step of securing comprises fastening said nosing to said stair tread with a single mechanical fastener at a position rearward of said exposed joint.

17. The method of claim 15 wherein said step of securing comprises gluing said nosing to said stair tread along said exposed joint.

18. The method of claim 15 wherein the step of securing further comprises fastening said tread to said nosing with a single mechanical fastener at a position rearward of said exposed joint, and gluing said nosing to said stair tread along said exposed joint.

* * * * *